US006216677B1

(12) United States Patent
McConnell et al.

(10) Patent No.: US 6,216,677 B1
(45) Date of Patent: Apr. 17, 2001

(54) EGR ASSEMBLY MOUNTED ON EXHAUST SYSTEM OF A HEAVY DUTY DIESEL ENGINE

(75) Inventors: Jason J. McConnell, Jackson; David W. Deppe, Marshall, both of MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/393,538

(22) Filed: Sep. 10, 1999

(51) Int. Cl.[7] ..... F02M 25/04; F02M 25/07

(52) U.S. Cl. ..... 123/568.24; 251/129.11; 123/568.12

(58) Field of Search ..... 123/568.24, 568.21, 123/568.12, 568.11; 251/129.11, 129.12, 129.13

(56) References Cited

U.S. PATENT DOCUMENTS 4,234,040 * 11/1980 Argyle et al. ..... 123/568.12
4,690,119 * 9/1987 Makino et al. ..... 123/568.23
5,606,957 3/1997 Feucht ..... 123/571
5,740,785 * 4/1998 Dickey et al. ..... 123/568.12
5,937,835 * 8/1999 Turner et al. ..... 123/568.24
6,012,437 * 1/2000 Radhamohan et al. ..... 123/568.23

* cited by examiner

*Primary Examiner*—Willis R. Wolfe
*Assistant Examiner*—Arnold Castro
(74) *Attorney, Agent, or Firm*—L. J. Kasper

(57) ABSTRACT

An exhaust gas recirculation (EGR) assembly (23) for an internal combustion engine, including an EGR valve (54) having a valve stem (55) reciprocating within a housing (61), between open (FIG. 3) and closed positions. Preferably, the EGR assembly is mounted on the exhaust manifold (15), and the EGR valve can communicate exhaust gas back to the intake manifold (13) in a known manner. The EGR assembly includes an electric motor (41), and a gear train (65) to move the EGR valve (54) in response to changes in an electrical input signal. A plurality of power electronic components (97) are disposed within a controls housing (91), which defines a slot (99) in face-to-face relation to a cooling chamber (81) defined by the housing (61) surrounding the valve stem (55). The cooling chamber (81) and the slot (99) cooperate to define a coolant passage, and the valve stem (55) and the power components (97) are in close proximity to the coolant passage, thus permitting the use of less expensive electrical components, rated for relatively lower temperatures.

7 Claims, 5 Drawing Sheets

EGR ASSEMBLY MOUNTED ON EXHAUST SYSTEM OF A HEAVY DUTY DIESEL ENGINE

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to an exhaust gas recirculation system for controlling the flow of exhaust gas from an exhaust manifold to an intake manifold of an internal combustion engine, and more particularly, to an improved actuator and control assembly for such an exhaust gas recirculation system.

Although the use of the present invention is not limited to any particular type or configuration of engine, its use is especially advantageous in connection with a heavy duty diesel engine, for reasons which will become apparent subsequently, and the invention will be described in connection therewith.

Typically, exhaust gas recirculation (EGR) valves have been disposed between the engine exhaust manifold and the engine intake manifold, and have been operable, when in the open position, to permit the recirculation of exhaust gas from the exhaust side of the engine back to the intake side. As is well known to those skilled in the art, such recirculation of exhaust gasses is helpful in reducing various engine emissions.

An EGR system including an electrically operated type actuator is illustrated and described in U.S. Pat. No. 5,606,957. The actuator for the valve stem in the cited patent is a stepper motor, which is generally satisfactory in performing the basic function of opening and closing the EGR valve, but does have a number of performance limitations. Another type of electrically operated actuator is illustrated and described in copending application U.S. Ser. No. 09/249,715, filed Feb. 12, 1999 in the names of Michael J. Sitar, David W. Deppe and Bill D. Wood, for an "EGR SYSTEM AND IMPROVED ACTUATOR THEREFOR", which is assigned to the assignee of the present invention and incorporated herein by reference. In the device of the above-incorporated application, the actuator includes an electric motor of the relatively high-speed, continuously rotating type, such as a permanent magnet DC commutator motor. The actuator also includes a reduction gear train, suitable to convert the output of the motor into a motion of the valve member which satisfies the operating requirements, in terms of the speed of movement of the valve member versus the force applied to the valve member, at any given position of the valve member during its opening and closing cycle.

In the case of either of the devices referred to above, there is a need for electrical/electronic controls, to control the opening and closing of the EGR valve, in response to variations in any one of a number of different engine operating conditions. Those skilled in the vehicle and engine arts understand that, at least in general, it is desirable for such controls to be integrated with the EGR valve and actuator assembly. If the controls are integrated into the actuator assembly, the required wiring harness is simplified, and the connection to the actuator motor and the position sensor can be internal to the actuator housing, thus protecting these connections from environmental problems. In some vehicle applications, there is simply not enough room available in the vehicle engine control module (ECU) to add the necessary control circuitry.

As is also well known to those skilled in the art, when dealing with a heavy duty diesel engine, and its various auxiliary components, temperature and the effects of various corrosive materials which are present must also be taken into account in designing and locating the various auxiliary components. Excessive temperatures can negatively effect performance of many components, and corrosive materials can negatively impact the life of the components.

It has been determined that when an EGR valve is located on the intake manifold side of a diesel engine, various pollutants in the exhaust gas have the opportunity to condense out of the stream of exhaust gas, because the intake manifold side of the engine is relatively cooler than the exhaust manifold side. The pollutants which condense out of the exhaust gas are of a type which tend to corrode the EGR valve and valve seat combination, as well as other system elements, such as the EGR cooler and associated pipes and plumbing. Thus, it has been determined that the EGR valve itself has better durability if it is located on the exhaust manifold side of the engine.

As was noted previously, it is desirable for the electronic controls associated with the EGR valve actuator to be integral with the EGR valve assembly. Unfortunately, if the EGR valve assembly is located on the exhaust manifold side of the engine, for the reasons discussed above, the electronic controls associated with the EGR valve actuator can no longer use the relatively inexpensive, commonly available electronic components which are typically rated for continuous operation at 125° Centigrade. Instead, having the EGR valve assembly on the exhaust manifold side of the engine would require electronic components which are rated for continuous operation at up to 400° Centigrade. Such components are either not yet readily available commercially, or if available, are extremely expensive.

BRIEF SUMMARY OF THE INVENTION

Accordingly, it is an object of the present invention to provide an improved EGR valve assembly, including the actuator and electronic controls, which make it possible to mount the EGR valve assembly on the exhaust manifold side of the engine.

It is a more specific object of the present invention to provide an improved EGR valve assembly which accomplishes the above-stated object, without the need for relatively expensive, high temperature electronic components.

It is an even more specific object of the present invention to provide an improved EGR valve assembly which includes a means for cooling the electronic components, in which the cooling means does not add any substantial size or packaging or cost to the assembly.

The above and other objects of the invention are accomplished by the provision of an improved exhaust gas recirculation assembly for an internal combustion engine, the assembly having a valve including a valve stem, the valve being moveable between a closed position, blocking communication from an engine exhaust gas passage to an engine intake passage, and an open position. The assembly comprises housing means, and the valve stem is disposed within the housing means for reciprocable movement therein. The assembly includes an electromagnetic actuator operably associated with the housing means, and having an actuator output. The assembly further includes a gear train operably associated with the actuator output and with the valve stem, to move the valve between the closed and open positions in response to changes in an electrical input signal. The gear train is disposed within the housing means. The assembly includes a plurality of power electrical components operable to generate the electrical input signal in response to a signal from the vehicle engine control module.

The improved exhaust gas recirculation assembly is characterized by the plurality of power electrical components being disposed within the housing means. The housing means defines a coolant passage including an inlet port for connection to a source of coolant. The coolant passage is configured to be in close proximity to the valve stem and to the plurality of power electrical components.

In accordance with a more specific aspect of the present invention, the exhaust gas recirculation assembly is characterized by the housing means including an exhaust manifold portion disposed in heat transmitting relationship to the vehicle engine exhaust manifold, and an intake manifold portion in only indirect communication with the vehicle engine intake manifold.

DETAILED DESCRIPTION OF THE PREFERRED EMBODIMENT

Figure 1:
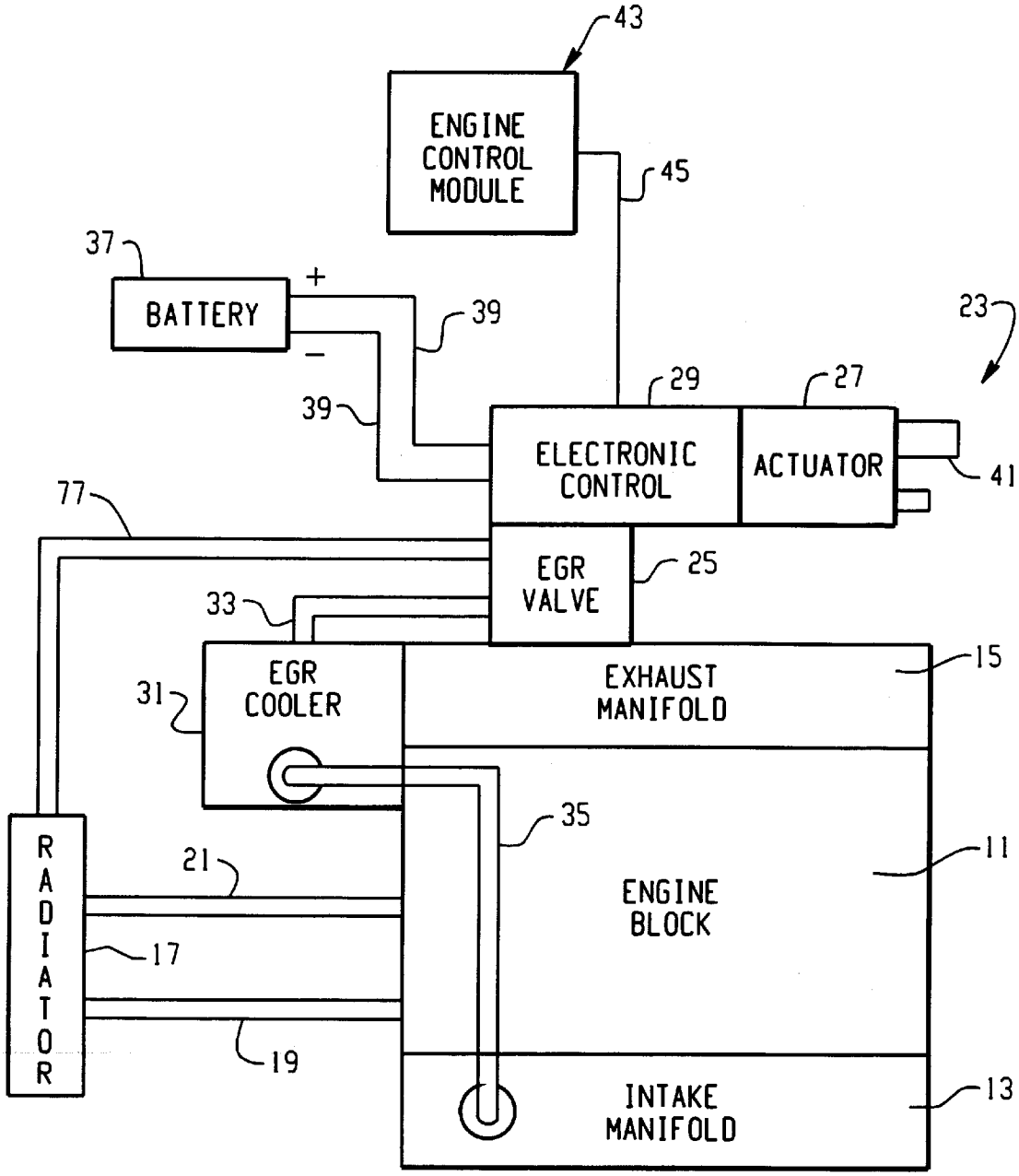
FIG. 1 is a schematic view of a diesel engine including the exhaust gas recirculation assembly made in accordance with the present invention.

Referring now to the drawings, which are not intended to limit the invention, FIG. 1 is a schematic of a vehicle internal combustion engine, and more specifically, of a heavy duty diesel engine. As is shown schematically in FIG. 1, the diesel engine includes an engine block 11 including an intake manifold 13 and an exhaust manifold 15. Disposed forwardly of the engine block 11 is an engine radiator 17, by means of which engine coolant flowing through the engine block 11 may be cooled as the coolant passes through the radiator 17. As is well known to those skilled in the art, the radiator 17 would typically be connected to the engine block 11 by means of a pair of hoses or conduits, one hose 19 communicating relatively hot engine coolant to the "top tank" portion of the radiator 17, and another hose 21 communicating relatively cooler engine coolant from the downstream end of the radiator 17 back to the engine block 11.

In accordance with one important aspect of the present invention, associated with the exhaust manifold 15 is an EGR valve assembly generally designated 23. The assembly 23 includes an EGR valve portion 25, an EGR valve actuator portion 27, and an actuator electronic control portion 29. Associated with the engine block 11 is an EGR cooler 31, the function of which is to cool the relatively hot exhaust gasses which are communicated from the EGR valve assembly 23 to the intake manifold 13. In order to accomplish this cooling of the exhaust gasses, the EGR valve portion 25 is connected by means of a duct or pipe 33 to the cooler 31, and exhaust gasses passing through the cooler 31 then flow through a duct or pipe 35 to the intake manifold 13.

The vehicle includes a battery 37 which is connected by means of a pair of electrical leads 39 to the actuator electronics portion 29, thus providing the electrical power for an electric motor 41 which comprises part of the EGR valve actuator portion 27. It should be understood that the present invention is not limited to any particular type or configuration of electric motor, for reasons which will become apparent subsequently, and within the scope of the present invention, various other forms of electromagnetic actuator could be utilized. The vehicle also is provided with a fairly conventional engine control module (ECM) generally designated 43. The ECM 43 receives input from the electronic control portion 29 (such as the instantaneous EGR valve position), and provides appropriate command signals to the electronic control portion 29 (such as the desired EGR valve position), by means of a data link 45, the command signal from the ECM 43 also being referred to hereinafter by the designation "45". The data link 45 is also used to send/receive information for diagnostic purposes, for example, to comply with various OBD (on-board diagnostics) regulations.

Figure 2:
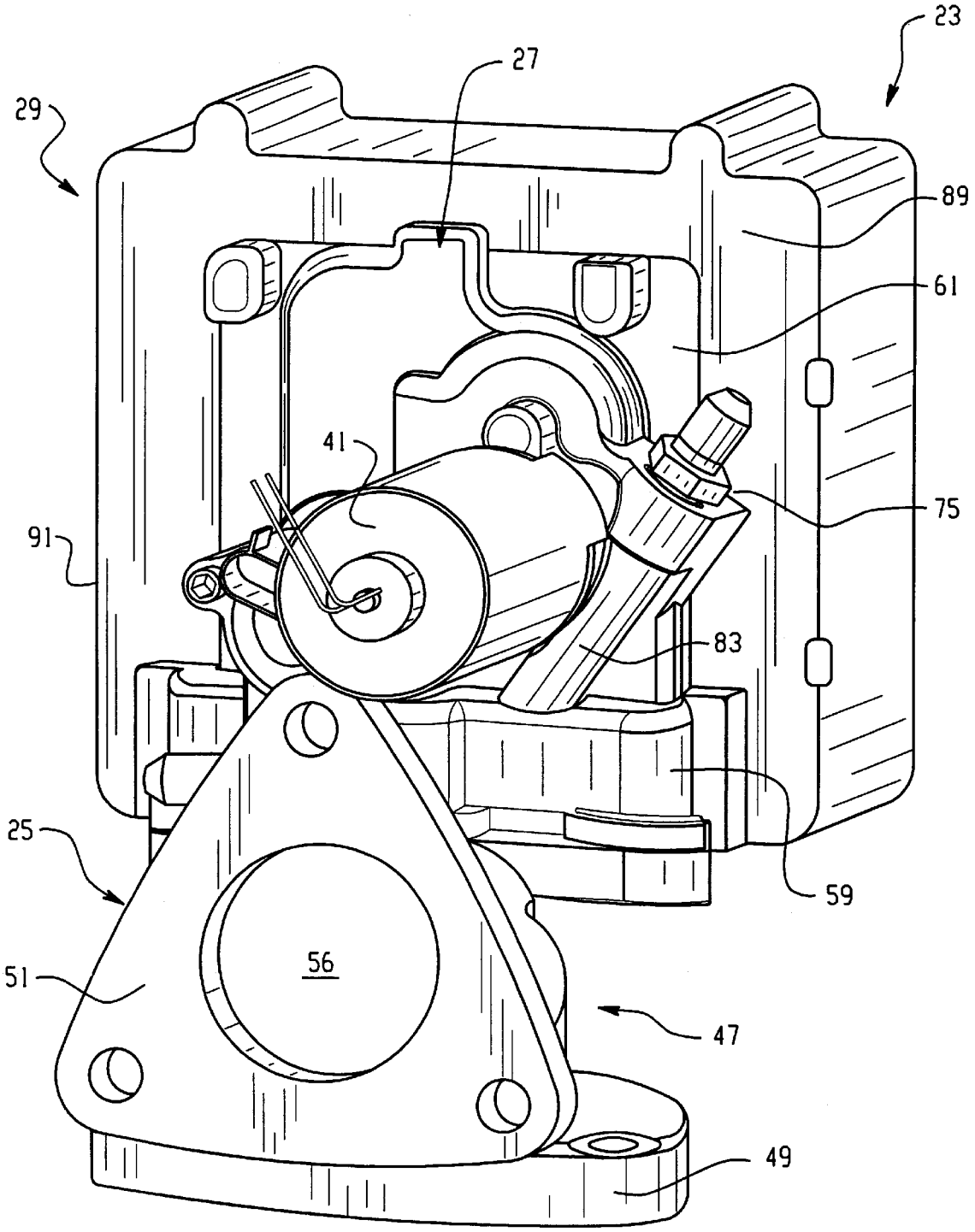
FIG. 2 is a perspective view of the exhaust gas recirculation assembly, made in accordance with the present invention, and as is shown schematically in FIG. 1.
Figure 3:
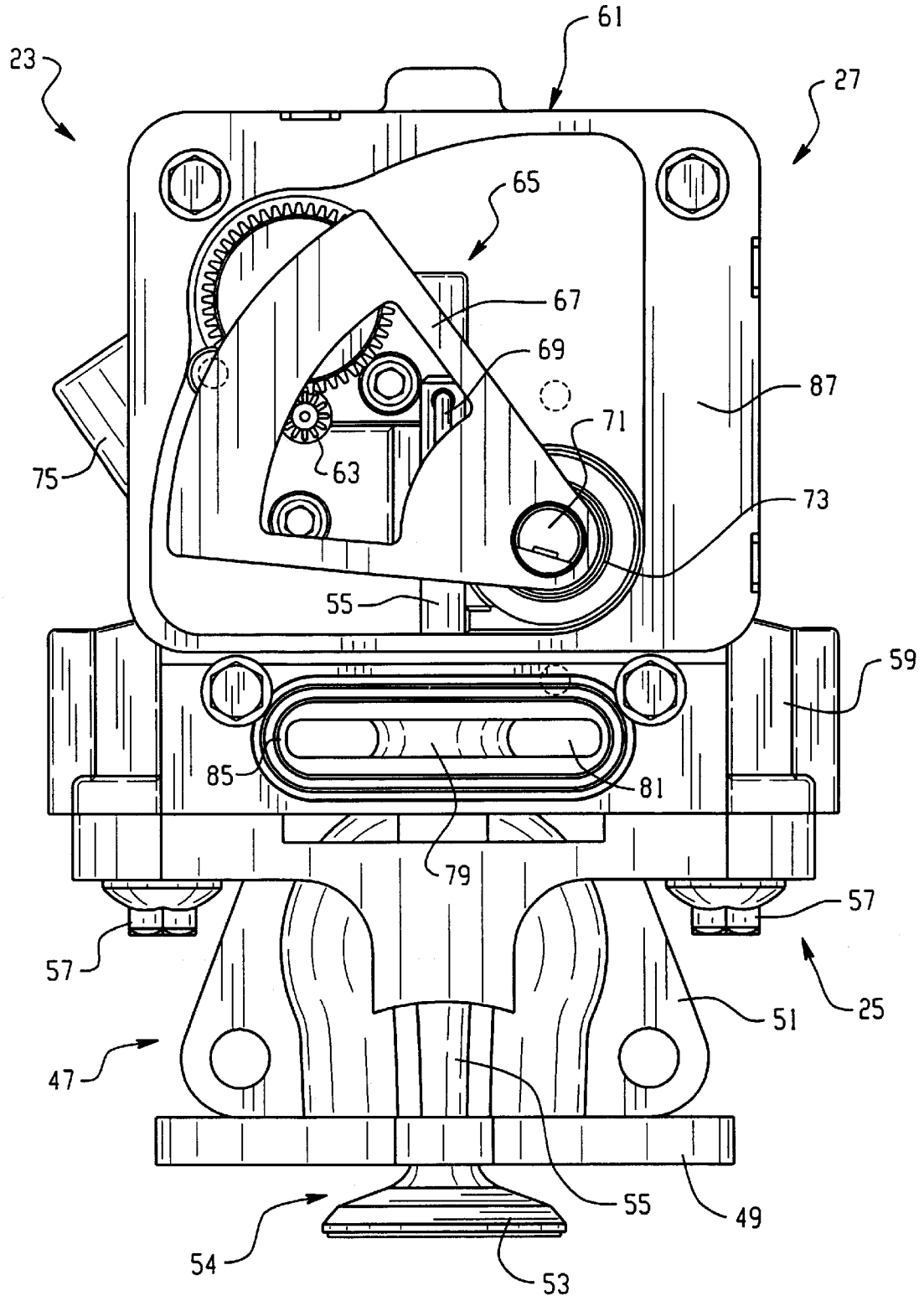
FIG. 3 is a front plan view, with the electronics portion removed, of the EGR valve actuator assembly, looking in a direction opposite that of FIG. 2.

Referring now primarily to FIGS. 2 and 3, the EGR valve assembly 23 will be described in some detail, it being understood that the EGR valve portion 25 and actuator portion 27 are described in great detail in the above-incorporated U.S. Ser. No. 09/249,715. The EGR valve portion 25 includes a manifold housing 47 including a mounting flange 49 adapted to be attached to the exhaust manifold 15, and a mounting flange 51 adapted to be connected to the duct 33. The mounting flange 49 is preferably disposed in a heat transmitting relationship with the exhaust manifold 15, i.e., such that heat is transmitted from the hot exhaust manifold 15 to the mounting flange 49, for reasons which were explained previously. The EGR valve portion includes a valve seat (not shown herein) against which is seated the poppet valve portion 53 of an EGR valve 54, which also includes a valve stem 55. As may best be seen in FIG. 3, the valve stem 55 extends upwardly into the EGR valve actuator portion 27.

The EGR valve 54 is shown in FIG. 3 in its open position, wherein exhaust gasses would be permitted to flow from the exhaust manifold 15 past the poppet portion 53 and then through a passage 56 (see FIG. 2) to the duct 33. In the subject embodiment, the manifold housing 47 is attached, such as by means of a plurality of bolts 57, to the undersurface of a heat transfer (cooling) portion 59. In the subject embodiment, the heat transfer portion 59 is actually formed integrally with an actuator housing 61 which encloses the EGR valve actuator portion 27.

Referring still primarily to FIGS. 2 and 3, the electric motor 41 has, as its output, a motor pinion gear 63 which comprises the input to a gear train, generally designated 65. In the subject embodiment, and by way of example only, the gear train 65 includes a pivotable sector gear 67, the pivotal movement of which is translated by means of a linkage member 69 into movement (vertically in FIG. 3) of the EGR valve 54 between its open position (shown in FIG. 3) and its closed position. The sector gear 67 pivots about a mounting shaft 71, and surrounding the mounting shaft 71 is a torsional spring 73 which serves as the return spring for the EGR valve 54, tending to bias the valve 54 toward its closed position (upward from the open position shown in FIG. 3).

The actuator housing 61 includes a portion 75 which is preferably internally-threaded and is therefore adapted to receive a threaded fitting associated with an engine coolant line 77 (see FIG. 1). Thus, the portion 75 serves as a coolant inlet port, such that engine coolant flows from the radiator 17 through the coolant line 77 and enters the actuator housing 61. As may best be seen in FIG. 3, the heat transfer portion 59 includes a valve stem support portion 79, which surrounds and supports the valve stem 55. The support portion 79 is surrounded by a cored cooling chamber 81 which is in open communication with the coolant inlet port 75 by means of a coolant passage defined by a portion 83 (see FIG. 2) of the actuator housing 61. Although not visible in any of the drawing figures, the coolant passage may also bear the reference numeral "83" hereinafter. The cooling chamber 81 opens at a surface 85 of the heat transfer portion 59, the surface 85 being co-planar with a surface 87 of the actuator housing 61. Preferably, both of the surfaces 85 and 87 are in engagement with a rearward surface 89 (see FIGS. 2 and 6) of a housing 91 which encloses the actuator electronic control portion 29.

Figure 4:
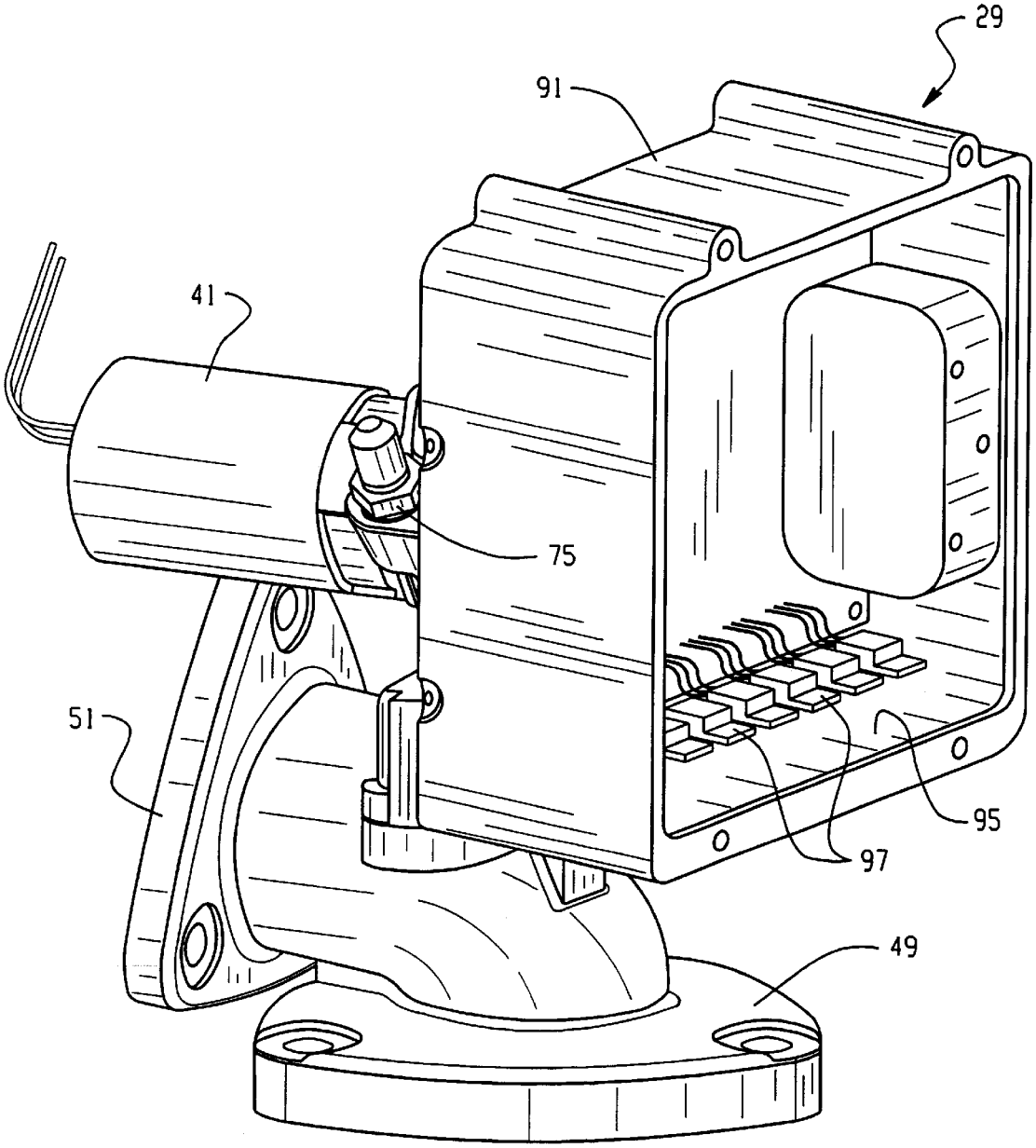
FIG. 4 is a perspective view, on approximately the same scale as FIG. 2, with the cover of the electronics portion, removed, illustrating one aspect of the present invention.
Figure 6:
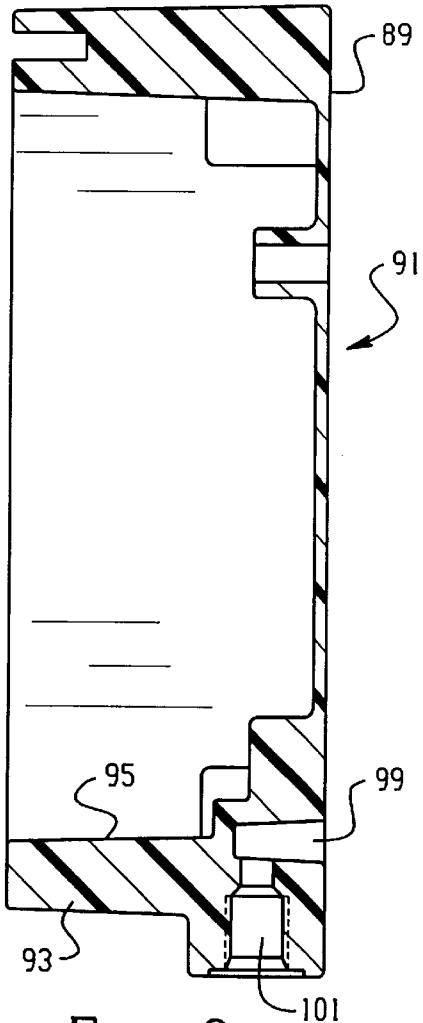
FIG. 6 is a transverse cross-section taken on lines 6—6 of FIG. 5, and illustrating one important aspect of the invention.
Figure 5:
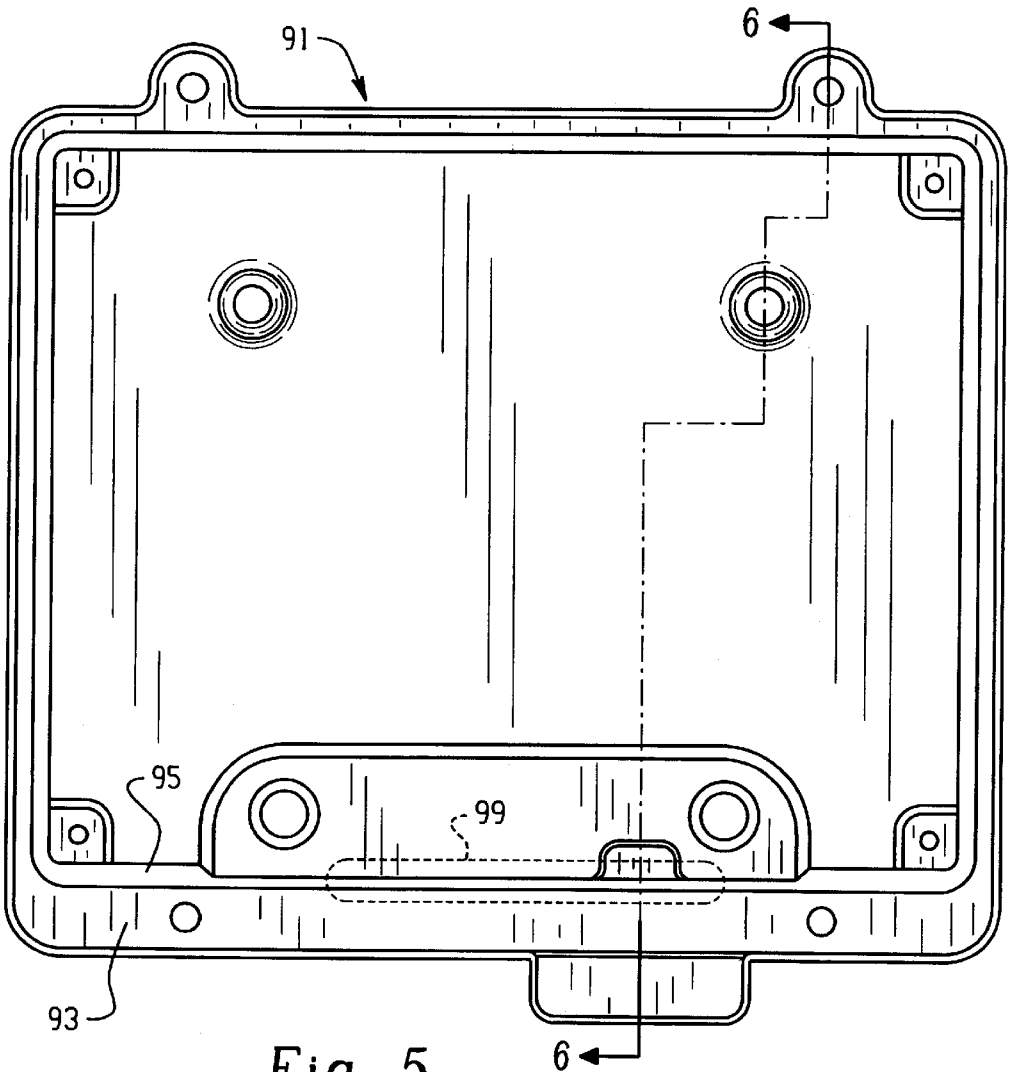
FIG. 5 is a plan view of the housing of the electronics module, with the cover removed, as well as the electronic components themselves, as viewed from the right in FIG. 4.

Referring now primarily to FIGS. 4–6, another important aspect of the invention will be described. The housing 91 for the electronic control portion 29 includes a relatively thicker bottom wall 93, the reason for the wall 93 being thicker to be described subsequently. Within the housing 91, and disposed on an inside surface 95, is a plurality of power electronic components, generally designated 97 (shown only in FIG. 4). Although in FIG. 4 the power electronic components 97 appear to be nearly identical, those skilled in the art will understand that the components 97 are shown that way for ease of illustration only. In actual practice, the electronic components 97 may include a variety of different power components, such as power transistors, diodes, voltage regulators, high power resistors, and others. In accordance with good design practice, and as one aspect of the invention, all or as many as possible of the power electronic components within the housing 91 which are relatively high heat generators would be included on the inside surface 95 as shown in FIG. 4. Those skilled in the art will understand that the electronic control portion 29 would typically also include various "low power" components, such as microprocessor logic gates, etc., which do not generate substantial heat. Therefore, such low power components would also be mounted within the housing 91, but aren't necessarily mounted on the inside surface 95. Instead, the low power components could be mounted anywhere within the housing 91, and references hereinafter, and in the appended claims, to "power electronic components" will be understand to refer primarily to those components which generate substantial heat, and have the greatest need for cooling.

In view of the presence of the various power electronic components 97, the thicker bottom wall 93 tends to become the hottest part of the housing 91. In order to dissipate the generated heat, the rearward surface 89 defines an elongated slot or recess 99, shown best in FIG. 6. The recess 99 is in open fluid communication with a coolant outlet port 101, from which engine coolant is communicated back to the radiator 17 by a suitable coolant line, not shown herein. Although the port 75 has been referred to as the inlet and the port 101 has been referred to as the outlet, those skilled in the art will understand that, within the scope of the invention, the ports 75 and 101 could be reversed, such that the direction of coolant flow would be reversed, and the overall operation of the invention would be substantially the same.

The shape of the recess 99, in a transverse direction, may best be seen in FIG. 5, and preferably, the recess 99 has approximately the same overall size and shape as does the opening of the cooling chamber 81 at the surface 85. Furthermore, it is greatly preferred that the opening of the cooling chamber 81 and the recess 99 are substantially co-extensive, i.e., they overlap and mate with each other. As a result, engine coolant enters the inlet port 75, flows through the passage 83, then enters the cooling chamber 81, at the left end thereof in FIG. 3, also flowing into the left end (in FIG. 5) of the recess 99. The coolant then flows generally to the right in both FIGS. 3 and 5, cooling both the valves stem support portion 79 and the portion of the bottom wall 93 containing the power electronic components 97. Then the coolant flows out the right end of the recess 99 through the coolant outlet port 101.

Thus, it may be seen that the present invention provides an improved EGR valve assembly 23 which makes it possible and feasible to mount the assembly on, or in close proximity to, the exhaust manifold 15. Furthermore, the invention includes an arrangement for cooling the power electronic components 97, and makes it possible to use relatively lower temperature components, wherein the cooling arrangement does not add any substantial structure, size, packaging or cost to the overall assembly 23.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. An exhaust gas recirculation assembly for an internal combustion engine, said system having a valve including a valve stem, said valve being moveable between a closed position, blocking communication from an engine exhaust gas passage to an engine intake passage, and an open position, said system comprising housing means, said valve stem being disposed within said housing means for reciprocable movement therein; an electromagnetic actuator operably associated with said housing means, and having an actuator output; a gear train operably associated with said actuator output and with said valve stem, to move said valve between said closed and open positions in response to changes in an electrical input signal, said gear train being disposed within said housing means; said assembly including a plurality of power electrical components operable to generate said electrical input signal in response to a signal from an vehicle engine control module; characterized by:

(a) said plurality of power electrical components being disposed within said housing means;

(b) said housing means defining a coolant passage including an inlet port for connection to a source of coolant; and (c) said coolant passage being configured to be in close proximity to said valve stem and to said plurality of power electrical components.

2. An exhaust gas recirculation assembly as claimed in claim 1, characterized by said housing means including an exhaust manifold portion disposed in heat transmitting relationship to the vehicle engine exhaust manifold.

3. An exhaust gas recirculation assembly as claimed in claim 2, characterized by said housing means including an intake manifold portion in only indirect communication with the vehicle engine intake manifold.

4. An exhaust gas recirculation assembly as claimed in claim 1, characterized by said housing means including a housing having a wall portion on which are mounted said power electronic components, said cooling passage being defined in part by said wall portion.

5. An exhaust gas recirculation assembly as claimed in claim 4, characterized by said wall portion defining a coolant outlet port in open fluid communication with said cooling passage.

6. An exhaust gas recirculation assembly as claimed in claim 1, characterized by said housing means including valve stem support means disposed in surrounding, supporting relationship to said valve stem, said valve stem support means being generally surrounded by said coolant passage.

7. An exhaust gas recirculation assembly as claimed in claim 6, characterized by said housing means including an actuator housing defining said valve stem support means, and a controls housing, said power electrical components being disposed within said controls housing, said actuator housing defining one portion of said coolant passage, and said controls housing defining another portion of said coolant passage, said one portion and said another portion of said coolant passage being disposed in open, face-to-face relationship with each other.

* * * * *